United States Patent [19]

Gilbride et al.

[11] 4,031,835

[45] June 28, 1977

[54] DEVICE FOR CLAMPING THE WORKPIECE IN A SEWING MACHINE

[75] Inventors: Andrew John Gilbride, Swampscott; John Frederick Martin, South Essex, both of Mass.

[73] Assignee: USM Corporation, Boston, Mass.

[22] Filed: May 7, 1976

[21] Appl. No.: 684,161

[52] U.S. Cl. ..... 112/76

[51] Int. Cl.[2] ..... D05B 3/00

[58] Field of Search ..... 112/76, 70, 65, 71, 112/72, 73, 74, 75, 104, 114

[56] References Cited

UNITED STATES PATENTS

| | | | |
|---|---|---|---|
| 2,040,260 | 5/1936 | Kenny | 112/70 X |
| 2,963,999 | 12/1960 | Braun et al. | 112/76 |
| 3,572,267 | 3/1971 | Beazley | 112/104 X |
| 3,669,043 | 6/1972 | Nicolay | 112/76 |
| 3,859,936 | 1/1975 | Bianchi | 112/76 |

*Primary Examiner*—H. Hampton Hunter

*Attorney, Agent, or Firm*—Ralph D. Gelling; Richard B. Megley; Vincent A. White

[57] ABSTRACT

This invention relates to a device for selectively actuating the workpiece clamp of an automatically controlled bar tacker sewing machine utilizing electrically operated pneumatic cylinders operatively connected to the upper clamping element to cause release of the workpiece. The clamp feet are releasably independent of other sewing operations. The upper clamping plate and the feed plate are secured to the clamp assembly by quick change fittings.

14 Claims, 7 Drawing Figures

37
35
36
34
32
25
26
31
20
24
21
27
22
23

DEVICE FOR CLAMPING THE WORKPIECE IN A SEWING MACHINE

BACKGROUND OF THE INVENTION

The device of this invention is designed for use in a bar tacking sewing machine. Bar tacking is the term used to describe the sewing of small stitch patterns which are generally used for reinforcing joints in shoes and other garments. These patterns are generally limited to a specific number of stitches in the range of from 10 to 100 stitches per pattern and cover only a small area of the workpiece. The operation is performed by moving the workpiece under the needle and this motion is achieved automatically by means of a work clamp which is mounted for movement along two axes relative to the needle. Work clamp movement is controlled by a style or feed cam which is operatively linked to the clamp. The style cam is generally driven by means of a shaft connected to the main needle bar drive shaft through a gear train. Thread cutting is controlled by a second cam connected to the same shaft but mounted opposite to the style cam.

Generally, the work clamp of this type of machine consists of a mechanically operated spring biased device which squeezes the workpiece between upper and lower clamping elements. The lower element is usually fixed in position with the upper element being forced downward by a spring which may be released by a lever associated with the thread cutting operation. The clamping elements have openings or windows which allow access to the workpiece by the sewing head. The pattern which is to be sewn is stitched within this opening. The upper clamping element may be split into a pair of separately releasable members to facilitate the clamping and registration of a workpiece which consists of multiple parts.

By operating the clamping mechanism in association with the thread cutter through a cam, a vary rigid sequence of events are forced into the sewing operation, namely, the workpiece will be unclamped immediately after the thread is cut without exception. This partially defeats the flexibility which is desired on automatically controlled machines where workpiece movement and collateral operations are under electronic control. In addition, where a dual element clamp is used, only a limited amount of separate movement can be achieved.

Specifically, in those instances where it is desired to sew several distinct designs in one pattern, it is possible that the thread will be cut repeatedly after each design. Unclamping the workpiece after each design would result in a loss of registration of the parts and this would require costly operator involvement and loss of time.

The clamp of this invention, therefore, releases the mechanism from the control of the knife actuating lever and provides separate pneumatic actuators which may be controlled automatically. For further ease of use quick change fittings are provided on the upper and lower clamping elements to allow fast removal and replacement when different patterns are to be sewn.

BRIEF SUMMARY OF THE INVENTION

The clamping device of this invention is designed to be actuatable independently from the other collateral functions of a bar tacking sewing machine such as thread cutting. To accomplish this, pneumatic cylinders are operatively connected to the dual clamping feet through bell crank levers to provide the release motion of the clamp. The bell crank levers engage the biasing springs of the clamp which are connected to the clamping feet. This motion may be triggered automatically through the control system of the machine or manually through a treadle switch. To increase the flexibility of the clamp operation quick disconnect fittings are used to connect the clamping feet and the feed plate to the clamp.

DESCRIPTION OF THE DRAWING

This invention is more fully described in conjunction with the appended drawing and in said drawing.

DETAILED DESCRIPTION OF THE INVENTION

Prior Art

The function of bar tacking is generally performed on a standard type sewing machine which is adapted to the purpose by the addition of a work clamp for holding and moving the workpiece through the tack pattern. This movement is accomplished automatically by means of a style cam operatively connected to the work clamp and the needle drive. The patterns which are sewn are predominantly for reinforcing purposes and cover only a small surface area of the workpiece. The overall movement and the number of stitches required is, therefore, limited.

Figure 1:
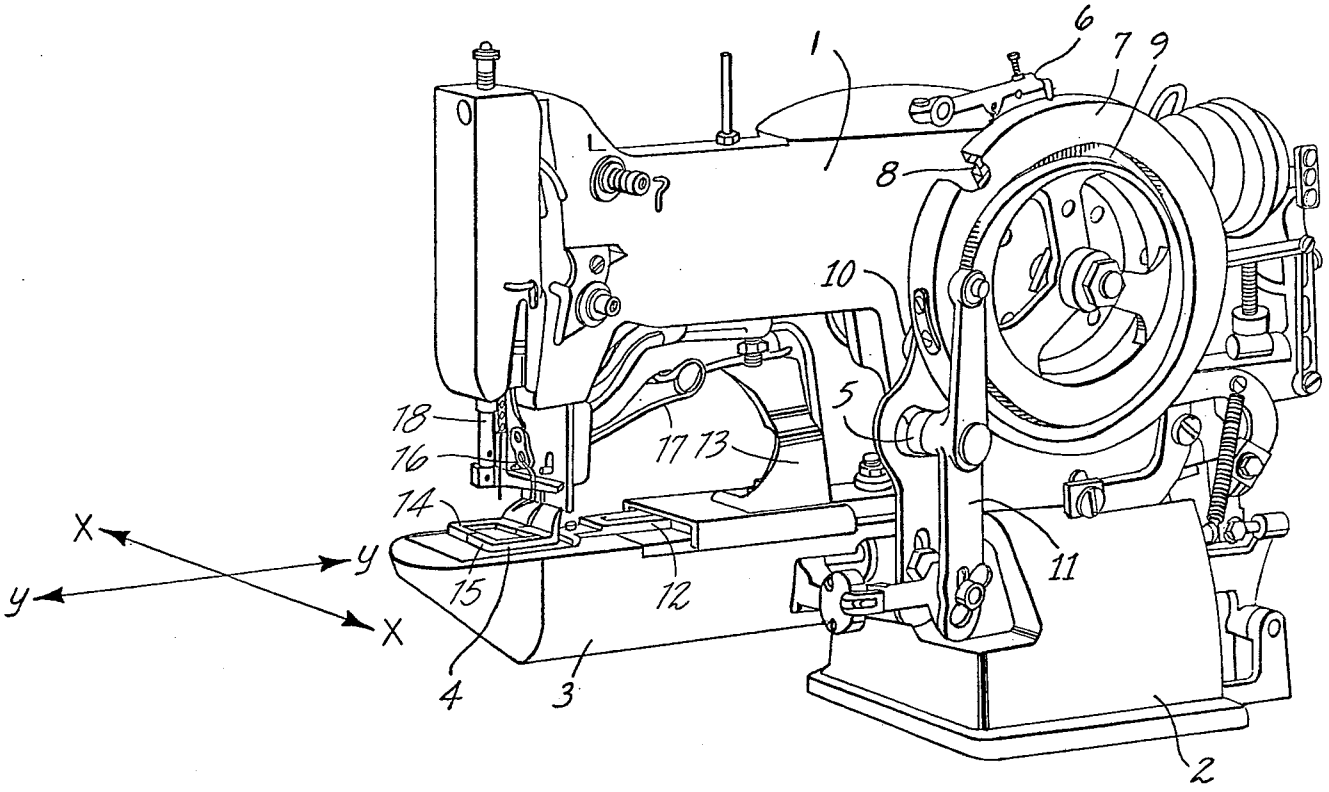
PRIOR ART Fig. 1
FIG. 1 is a perspective view of a bar tacking sewing machine showing the workpiece clamp of the prior art.

With reference to FIG. 1 the bar tacker sewing machine of the prior art is provided with a housing 1 mounted on a base 2. The housing 1 encloses a drive shaft, a cam shaft, a gear train connecting the drive and cam shafts as well as the needle bar drive linkages. Extending outward from base 2 under housing 1 is cylinder bed 3 which contains the feed mechanism for moving the workpiece clamp 4. The feed mechanism is linked to the two armed lever assembly 5.

In the prior art machine the principal motions for the complete bar tack operation are derived from two cams, which are mounted on either side of the housing on a transverse cam shaft geared to the needle drive shaft. The feed movement is along the axis X and Y as shown in FIG. 1 and this motion originates in the feed or style cam 7. The cam 7 has inside and outside tracks 8 and 9 of which track 8 controls lengthwise motion Y and track 9 controls transverse motion X through vertical two armed levers 10 and 11 respectively.

In order to insure continuous engagement between thread and needle, style cam 7 is also provided with means to actuate a nipper lever 8 which in turn operates a nipper which holds the thread tightly against the needle bar, and prevents thread pullout during start up and thread cutting. The knife cam of the prior art (not shown in FIG. 1) is located on the cam shaft on the opposite side of housing 1 from style cam 7 and provides the timing and movement for two functions, namely thread cutting and workpiece release.

The prior art machine is controlled by two foot actuated treadles mechanically connected to the sewing machine. One treadle starts and stops machine operation while the second treadle operates the thread cutting stroke and sequentially the workpiece release motion. All other movements are provided by either the style cam or the knife cam both of which rotate in timed relation with needle reciprocation.

The work clamp of the prior art consists of bottom clamp element 12 which is attached to support arm 13. Upper clamp elements 14 and 15 are mounted on support arm 13 for vertical sliding movement away from bottom element 12. Springs 16 and 17 are fixed to support arm 13 and engage the upper clamp elements 14 and 15 respectively to urge said elements downward into firm engagement with bottom clamp element 12. In order to overcome the clamping force of springs 16 and 17 and release a workpiece held thereby, a lever 18 is provided which engages the producing ends of the springs 16 and 17. The lever 18 is lifted vertically by the action of a knife actuating lever (not shown) which in turn is actuated by a knife cam. This system requires that the clamp be released with each cutting stroke of the knife. In addition, it can be seen that it would be difficult to operate the dual upper clamp elements 14 and 15 individually.

THE PREFERRED EMBODIMENT

Figure 2:
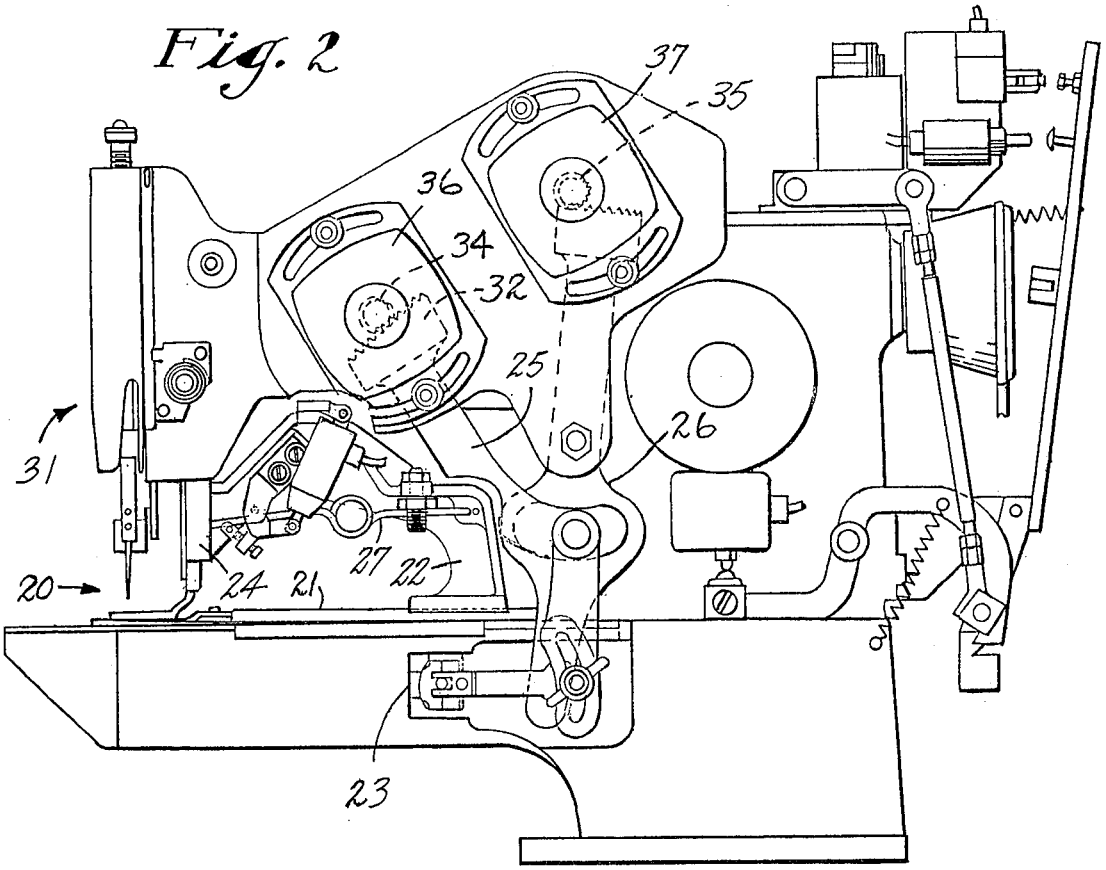
FIG. 2 is a side view of a bar tacking sewing machine showing the clamp of the subject invention.
Figure 7:
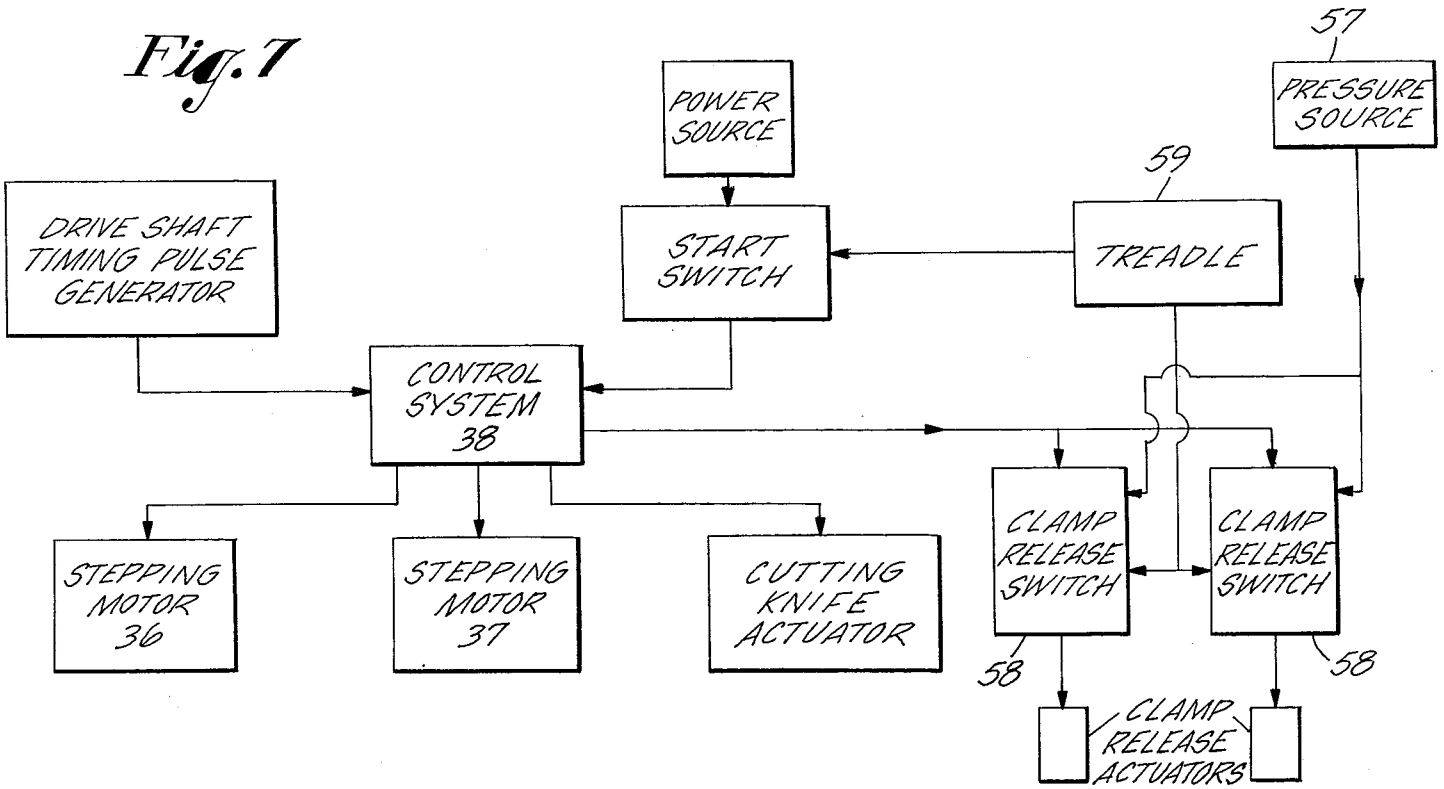
FIG. 7 is a block diagram of a control system for this sewing machine utilizing this invention.

The automatically controlled bar tacker sewing machine associated with this invention employs the standard mechanism and is best shown in FIG. 2. In order to provide motion for the work clamp 20, the operation levers 25 and 26 are connected through linkage 23 to the clamp 20 and have gear sectors 32 and 33 fixed to the upper end of the lever arms. The gear sectors 32 and 33 mesh with pattern drive gears 34 and 35. The gears 34 and 35 are driven by stepping motors 36 and 37 as shown in FIG. 2. Each of the stepping motors is constructed to respond with a specific degree of rotary motion for each drive pulse it receives. As shown in FIG. 7, in order to generate the drive signal, a digital control 38 is provided which may be programmed to generate the pulses necessary to cause movement of the workpiece through a predetermined tack pattern. The programmed instruction may be in the form of a PROM (Programmable Read Only Memory) which may be inserted into circuitry of control 38 to cause generation of the pulses necessary for the desired pattern. To obtain different patterns, all that is needed is to change to a different PROM. A bar tacking sewing machine of this type is described in U.S. Pat. application Serial No. 530,048.

Figure 3:
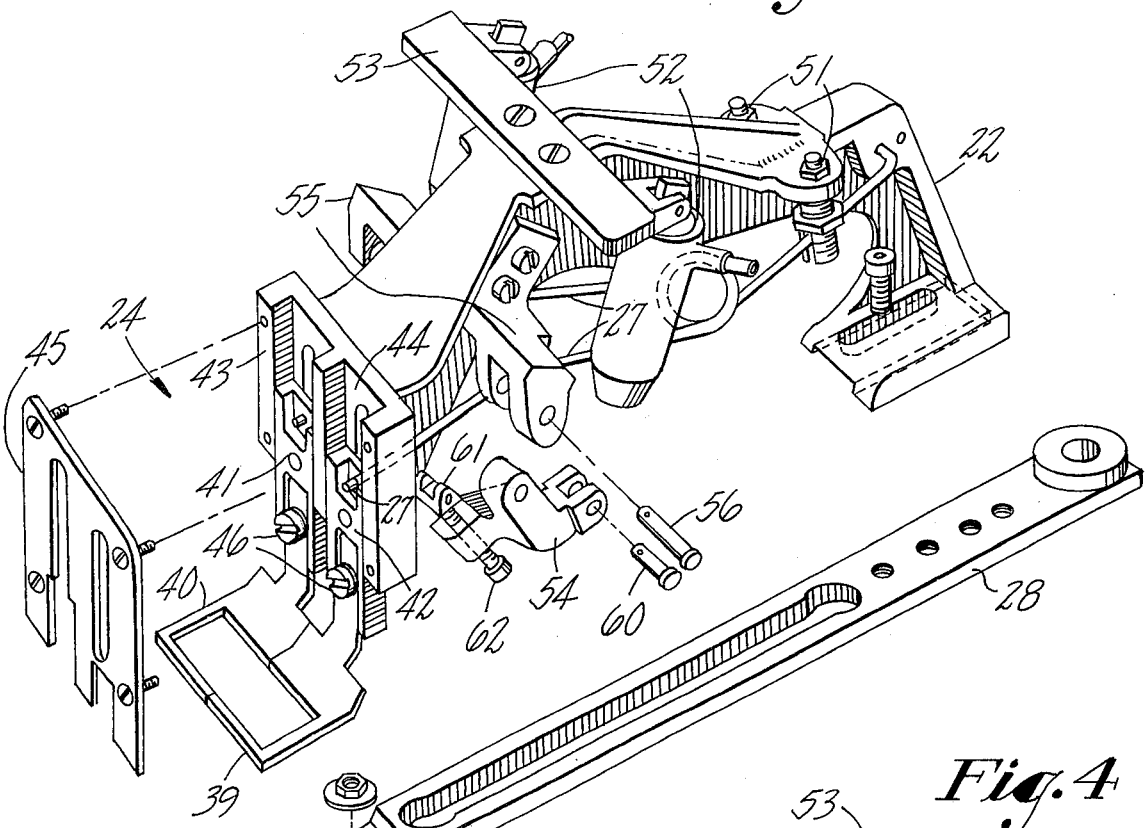
FIG. 3 is a perspective exploded view of the clamp assembly of this invention.
Figure 4:
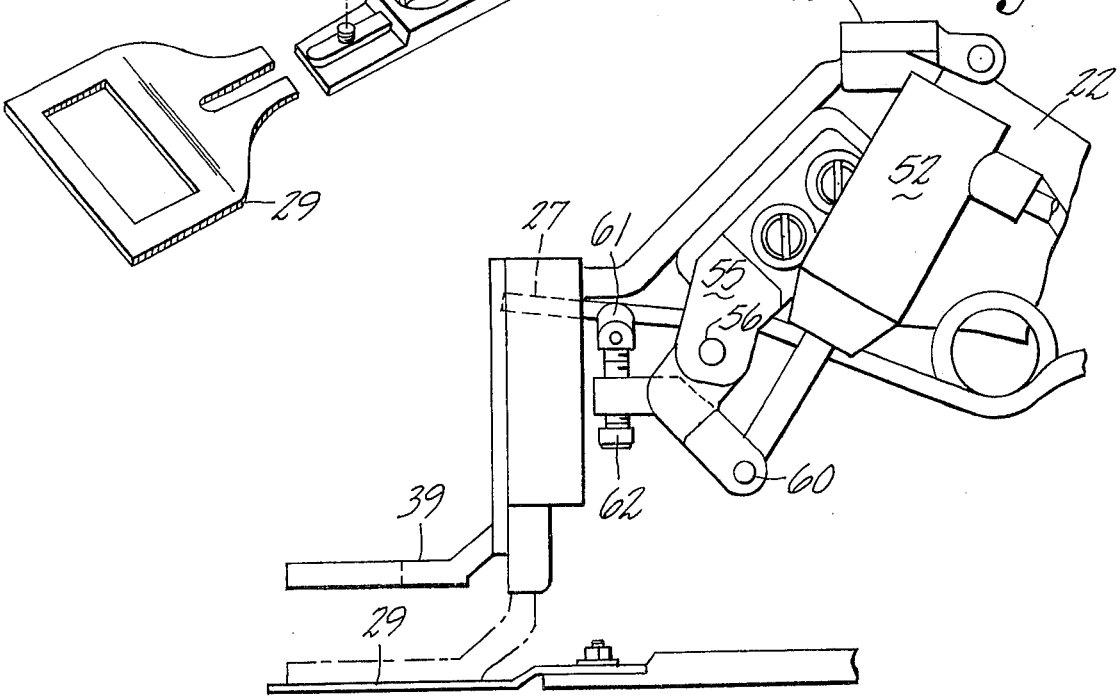
FIG. 4 is a partial side view of the clamp showing the unclamped position.
Figure 5:
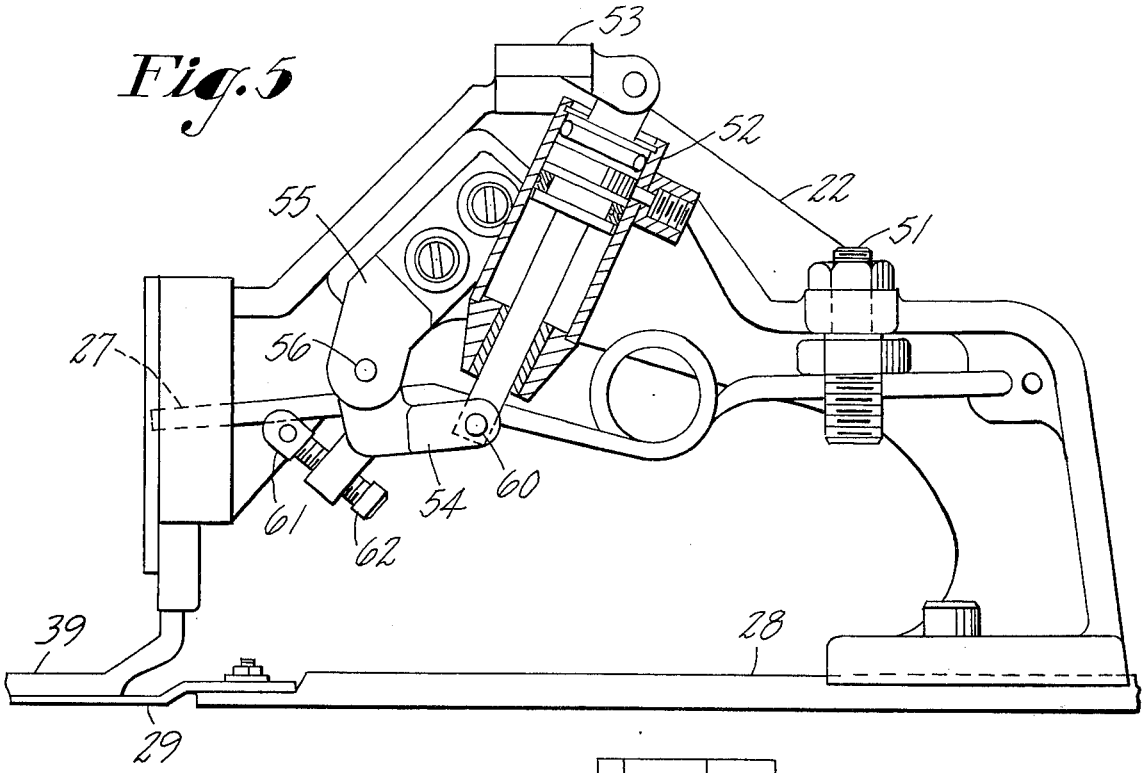
FIG. 5 is a partial side view of the clamp showing the clamped position.
Figure 6:
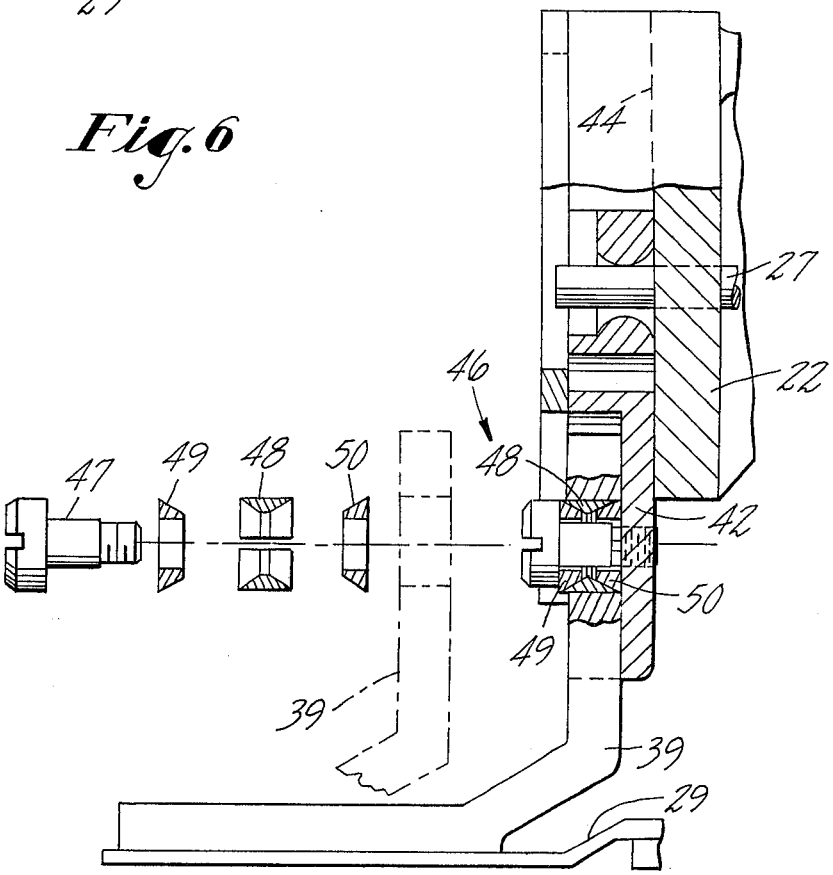
Fig. 6 is a partial section view of the clamp feet showing the quick disconnect fittings.

The work clamp assembly 20 of this invention is shown in FIG. 2 in association with an automatically controlled bar tacking sewing machine as described above. As best shown in FIG. 3, the assembly 20 consists of a lower clamping element 21, a support arm 22 fixed to lower element 21 and an upper clamping element 24. The upper clamping element 24 is slidably mounted on arm 22 for vertical movement into clamping position. Spring bars 27 are fixed to support arm 22 and engage upper clamp element 24 to resiliently bias this element downward into engagement with the lower clamping element 21.

Lower clamping element 21 is an assembly of carrying arm 28 and feed plate 29. The feed plate 29 being connected to carrying arm 28 by means of a quick disconnect fitting 30. The composite element 21 forms the base for the clamp assembly 20 and is attached to the sewing machine for movement in the *x* and *y* coordinates shown in FIG. 1. The support arm 22 is fixed to the carrying arm 28.

The upper clamping element 24 consists of a pair of mated clamp feet 39 and 40 which are each separately mounted on slides 41 and 42. The slides 41 and 42 are in turn mounted for vertical sliding motion in grooves 43 and 44 and are held in place by plate 45. Each of the clamping elements is constructed with a window to allow access to the workpiece. The shape of this window must be varied depending upon the pattern to be sewn. In order to facilitate removal of the feet 39 and 40 to change the size or shape of the window, they are secured to the slides 41 and 42 by means of quick disconnect fittings 46. The fittings 46 may consist of screw 47, split collar 48 and wedge collars 49 and 50. In this manner the feet 39 and 40 may be removed quickly without complete removal of the screw 47.

In order to force the clamp feet 39 and 40 into engagement with the feed plate 29, spring bars 27 are mounted on either side of arm 22 and are connected to slides 41 and 42 through slots 31. The biasing force of spring 27 is set downward and may be adjusted by tension bolts 51.

The unclamping force is supplied by pneumatic piston and cylinder assemblies 52 which are mounted on support arm 22 through bracket 53. The pistons of the assembly 52 are connected to bell crank levers 54 by pins 60. The bell crank levers are pivotally mounted on both sides of the support arm through pivot brackets 55 and pins 56. Cams 61 are mounted on one end of the bell crank levers 54 by adjustment bolts 62 and engage the spring bars 27 to move the spring bars 27 and, therefore, the slides 41 and 42 upward upon actuation of piston and cylinder assemblies 52. This action will release the workpiece from the clamp.

As shown in FIG. 7, the pressure source 57 to the piston and cylinder assemblies 52 is controlled by electrical valve switch 58 which may be actuated by a signal from automatic control system 38 or manually through treadle 59. In this manner selective independent release of the clamp assembly feet 39 and 40 can be achieved without dependence on any other function of the sewing machine. This will result in a faster, more flexible and accurate sewing operation. It is observed that piston and cylinder assemblies 52 could be replaced by electric solenoids without detracting from the operation of the invention.

We Claim:

1. In a bar tacker sewing machine having means to secure the workpiece for movement through a predetermined pattern under the stitching instruments of the sewing machine, a workpiece clamp comprising:

A. a lower clamping element operatively connected to the sewing machine for movement through the predetermined pattern;

B. a support arm fixed to the lower clamping element and extending under the stitching instruments of the sewing machine;

C. an upper clamping element mounted on the support arm for movement into and out of clamping engagement with the lower clamping element;

D. biasing means resiliently forcing the upper clamping element into clamping engagement with the lower clamping element;

E. remotely actuatable means mounted on the support arm and operatively connected to the upper clamping element to cause movement thereof against the biasing means to release the workpiece; and, F. electrically operated control means to cause actuation of the workpiece release means.

2. In a bar tacker sewing machine having means to secure the workpiece for movement through a predetermined pattern under the stitching instruments of the sewing machine, a workpiece clamp as described in claim 1 wherein the remotely actuatable means comprises an electrically operated solenoid.

3. In a bar tacker sewing machine having means to secure the workpiece for movement through a predetermined pattern under the stitching instruments of the sewing machine, a workpiece clamp as described in claim 1 wherein the remotely actuatable means comprises a pneumatically actuated piston and cylinder assembly.

4. In a bar tacker sewing machine having means to secure the workpiece for movement through a predetermined pattern under the stitching instruments of the sewing machine, a workpiece clamp as described in claim 1 wherein the upper clamping element is comprised of a pair of clamp feet separately mounted on the support arm for independent movement into and out of clamping engagement with the lower clamping element.

5. In a bar tacker sewing machine having means to secure the workpiece and move said workpiece through a predetermined pattern under the stitching instruments of the sewing machine, a workpiece clamp as described in claim 3 wherein each mated member of the upper clamping element is individually resiliently forced into clamping engagement with the lower clamping element by biasing means.

6. In a bar tacker sewing machine having means to secure the workpiece for movement through a predetermined pattern under the stitching instruments of the sewing machine, a workpiece clamp as described in claim 4 wherein each mated member of the upper clamping element is operatively connected to a remotely actuatable means to cause movement of each of said mated members against the biasing means to relase the workpiece.

7. In a bar tacker sewing machine having means to secure the workpiece for movement through a predetermined pattern under the stitching instruments of the sewing machine, a workpiece clamp as described in claim 5 wherein the electrically operated control means is connected to each of the workpiece release means and is adapted to cause independent actuation thereof.

8. In a bar tacker sewing machine having means to secure the workpiece for movement through a predetermined pattern under the stitching instruments of the sewing machine, a workpiece clamp comprising:

A. a lower clamping element operatively connected to the sewing machine for movement through the predetermined pattern, and extending under the stitching instruments of the sewing machine;

B. a support arm fixed to the lower clamping element;

C. A pair of mated clamping feet individually mounted on the support arm for independent sliding movement into and out of clamping engagement with the lower clamping element;

D. a pair of spring bars mounted on either side of the support arm and operatively connected to each of the clamping feet to force said feet into clamping engagement with the lower clamping element;

E. a pair of pneumatically actuated piston and cylinder assemblies mounted on either side of the support arm and operatively connected to each of the clamping feet to cause independent movement thereof against the force of the spring bars to release the workpiece; and F. electrically operated control means to cause selective actuation of the piston and cylinder assemblies.

9. In a bar tacker sewing machine having means to secure the workpiece for movement through a predetermined pattern under the stitching instruments of the sewing machine, as described in claim 8 wherein the pneumatically operated piston and cylinder assemblies are replaced by electrically operated solenoid assemblies.

10. In a bar tacker sewing machine having means to secure the workpiece for movement through a predetermined pattern under the stitching instruments of the sewing machine, as described in claim 8 wherein the lower clamping element comprises:

A. a carrying arm connected to the sewing machine for movement through the predetermined pattern, and adapted to receive the support arm; and, B. a feed plate releasably attached to the carrying arm by means of quick disconnect fittings, said feed plate extending under the stitching instruments.

11. In a bar tacker sewing machine having means to secure the workpiece for movement through a predetermined pattern under the stitching instruments of the sewing machine, as described in claim 8 wherein the pair of mated clamping feet are releasably mounted on the support arm by means of quick change disconnect fittings.

12. In a bar tacker sewing machine having means to secure the workpiece for movement through a predetermined pattern under the stitching instruments of the sewing machine, a workpiece clamp comprising:

A. a lower clamping element operatively connected to the sewing machine for movement through the predetermined pattern;

B. a support arm fixed to the lower clamping element and extending under the stitching instruments of the sewing machine;

C. an upper clamping element mounted on the support arm for movement into and out of clamping engagement with the lower clamping element;

D. remotely actuatable clamp means mounted on the support arm and operatively connected to the upper clamping element to force the upper clamping element into clamping engagement with the lower clamping element;

E. biasing means mounted on the support arm and operatively connected to the upper clamping element to cause movement thereof to release the workpiece; and, F. electrically operated control means to cause actuation of the workpiece clamp means.

13. In a bar tacker sewing machine having means to secure the workpiece for movement through a predetermined pattern under the stitching instruments of the sewing machine, a workpiece clamp as described in claim 12 wherein the remotely actuatable means comprises an electrically operated solenoid.

14. In a bar tacker sewing machine having means to secure the workpiece for movement through a predetermined pattern under the stitching instruments of the sewing machine, a workpiece clamp as described in claim 12 wherein the remotely actuatable means comprises a pneumatically actuated piston and cylinder assembly.

* * * * *